US005549044A

United States Patent [19]

Achelpohl

[11] Patent Number: 5,549,044

[45] Date of Patent: Aug. 27, 1996

[54] PRINTING PRESS INCLUDING A MECHANISM FOR EXCHANGING CYLINDERS

[75] Inventor: Fritz Achelpohl, Lienen, Germany

[73] Assignee: Windmöller & Hölscher, Lengerich/Westf., Germany

[21] Appl. No.: 419,010

[22] Filed: Apr. 7, 1995

[30] Foreign Application Priority Data

Apr. 20, 1994 [DE] Germany ..... 44 13 807.5

[51] Int. Cl.[6] ..... B41F 5/00

[52] U.S. Cl. ..... 101/216; 101/174; 101/477

[58] Field of Search ..... 101/212, 216, 101/153, 174, 141, 142, 477

[56] References Cited

U.S. PATENT DOCUMENTS

| | | | |
|---|---|---|---|
| 2,792,781 | 5/1957 | Kaldschmidt | 101/216 |
| 3,173,361 | 3/1965 | Verlik | 101/216 |
| 3,174,724 | 3/1965 | Verlik | 101/216 |
| 3,876,087 | 4/1975 | Osta | 101/216 X |
| 5,188,027 | 2/1993 | Fantoni | 101/216 |
| 5,275,105 | 1/1994 | Schweizer et al. | 101/477 |

*Primary Examiner*—Christopher A. Bennett
*Attorney, Agent, or Firm*—Keck, Mahin & Cate

[57] ABSTRACT

A printing press consists of several printing units arranged in a row, each having one inking unit, and cylinders exchangeable for diverse print runs, the bearings of the exchangeable cylinder being arranged on a carriage displaceable in the printing press frame. An impression cylinder is mounted in the printing press frame. The printing press includes means for lifting out and removing the exchangeable cylinders. The conveyance means has a trolley displaceable on a rail. To allow the cylinders to be easily and rapidly exchanged the carriages are displaceable on at least one horizontal guide means of each printing press frame. Lifting jacks are assigned to the shaft journals projecting outwardly from the bearings. The trolley is displaceable on a rail approximately parallel to the carriages of all the printing units, extends over the length of all the printing units, and has assigned to each printing unit pairs of freely projecting arms which are substantially parallel to the carriage guide means, with receiving means for the shaft journals of the exchangeable cylinders. The lifting jacks can be lifted above the arms.

6 Claims, 7 Drawing Sheets

PRINTING PRESS INCLUDING A MECHANISM FOR EXCHANGING CYLINDERS

FIELD OF THE INVENTION

The invention concerns a printing press, preferably a flexographic priming press, consisting of several printing units arranged in a row, with one inking unit each, and with cylinders exchangeable for diverse print runs. Preferably each printing unit has an inking roller and a plate cylinder whose bearings are arranged on a carriage displaceable in the priming press frame, and there is an impression cylinder mounted in the frame of the press, in which arrangement the printing press includes means for lifting the exchangeable cylinders out and for removing them, using a conveyance means which has a trolley displaceable on rails.

PRIOR ART

In a wet offset printing press of this kind known from AT-B-287,021, a plate cylinder, a blanket cylinder and an impression cylinder are arranged in the frame of the printing press on top of one another, in which arrangement two laterally arranged rails are disposed beneath each cylinder for outward movement. The cylinders can be positioned on the rails and from them they can be moved out of the frame of the printing press, so that they can be simultaneously lifted out in their superposed position by a suspension tackle forming the conveyance means. The suspension tackle is connected to a hoist which is suspended on the trolley which is displaceable on a rail.

With printing presses, fairly small print runs have to be frequently executed and these require a change-over of the printing press for a new nm after relatively short machine runs, which necessarily entails down-times. The economic efficiency of a priming press depends decisively on its operating periods, which means that the down-time due to change-over operations has to be reduced as far as possible.

Admittedly, the printing press known from the AT-B-287, 021 makes it possible to lift out simultaneously three cylinders arranged on top of one another, and correspondingly to reinsert three exchanged cylinders also simultaneously. However, the lifting out and reinsertion of the cylinders is effected by means of a single suspension tackle suspended on a hoist, in which arrangement the hoist is joined to a trolley displacing it. The change of cylinders for a new print run is therefore still very time-consuming with the known printing press, since the cylinders of each printing unit have to be lifted out separately from each other, and the changed cylinders have to be subsequently reinserted.

OBJECT OF THE INVENTION

It is therefore a principal object of the invention to create a printing press of the kind indicated at the outset above, whereby the required cylinders can be easily and quickly changed in the case of a change-over from one print run to another, so as to shorten the down-time.

SUMMARY OF THE INVENTION

In accordance with the invention, this problem is solved by a priming press, consisting of a row of several printing units each having one inking unit, cylinders exchangeable for diverse print runs and having their bearings arranged on a carriage displaceable in the printing press frame, and an impression cylinder mounted in the machine frame; wherein the printing press includes means for lifting out and removing the exchangeable cylinders, and conveyance means including a trolley displaceable on a rail; wherein the carriages are displaceable on at least one horizontal guide means of each printing press frame; wherein lifting jacks are assigned to the shaft journals of the exchangeable cylinders of each printing unit, which journals project outwardly beyond the bearings; wherein the trolley is displaceable on a rail approximately parallel to the carriages of all the printing units; wherein the trolley extends over the length of all the printing units and has pairs, assigned to each printing unit, of freely projecting arms that are substantially parallel to the carriage guide means, with receiving means for the shaft journals of the exchangeable cylinders; and wherein the lifting jacks can be raised above the arms.

In the printing press in accordance with the invention, the cylinders to be exchanged in each printing unit can be lifted above the arms by raising the lifting jacks after release of the bearings, which are conveniently conventional hinged bearings, so that the arms of the trolleys can be moved below the shaft journals of the lifted-out cylinders, and can be deposited in the receiving means of the arms by lowering the lifting jacks. The corresponding lifting out of those cylinders of all the printing units to be exchanged can be effected simultaneously, or in quick succession. By displacing the trolley, all the cylinders to be exchanged are then simultaneously moved away and can be stocked in a store.

The trolley may have two pairs of arms assigned to each printing unit, of which one pair serves to hold freshly fed cylinders, and the other pair serves to receive the cylinders to be exchanged. Thus in this design, the new cylinders are fed by the trolley to all the printing units simultaneously, these cylinders being received by the lifting jacks, after the cylinders to be exchanged have been deposited on the receiving means of the arms provided for them, and then being inserted into the respective printing units by lowering the lifting jacks.

Expediently, the respective two pairs of freely projecting arms are directed towards each other with their free ends; in such an arrangement the ends are interspaced from each other by such a distance that the groups of lifted-out cylinders can be freely carried by the lifting jacks between these ends.

To allow the trolley to be easily and rapidly displaced between the corresponding positions during (i) the depositing of the cylinders to be exchanged, and (ii) the reception of the new cylinders, the trolley is expediently provided with a positioning drive.

BRIEF DESCRIPTION OF THE DRAWINGS

An embodiment of the invention will be explained below in greater detail with reference to the drawings, in which.

DETAILED DESCRIPTION OF THE PREFERRED EMBODIMENT

Figure 1:
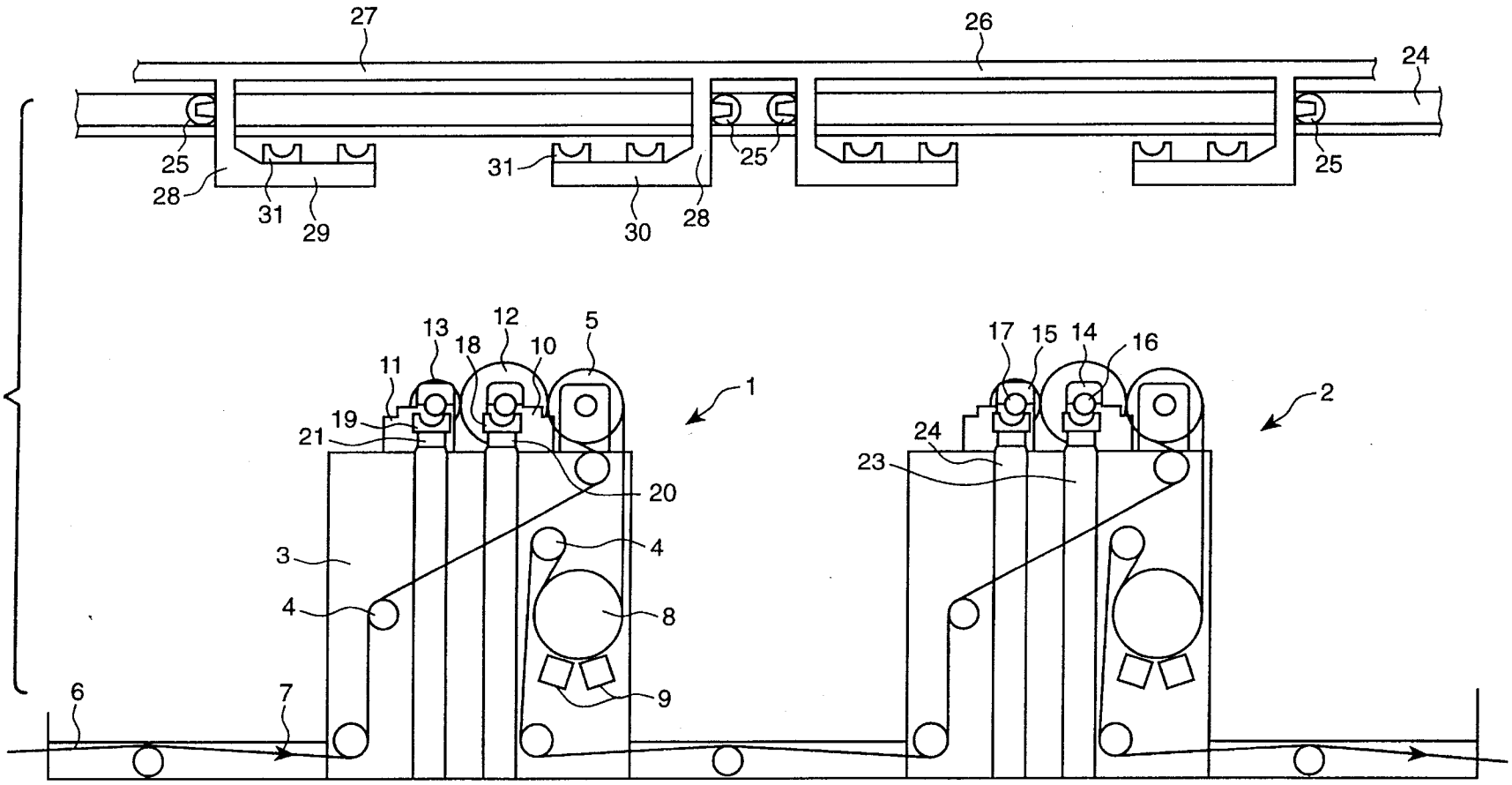
FIG. 1 is a schematic side view of two printing units of a flexographic printing press with a trolley displaceable above them in a rail fixed in position, this trolley being provided with two respective freely projecting horizontal arms assigned to each printing unit, for receiving the new cylinders and the cylinders to be exchanged.

The flexographic printing press represented by way of example may, for example consist of four to six printing units of which two printing units (1, 2) are shown in FIG. 1. All the printing units of the flexographic printing press are aligned in a straight line with respect to each other.

The individual printing units (1, 2) have the usual printing press frames (3), wherein the guide rollers (4) and the impression cylinder (5) are mounted. The web (6) to be printed on rum in the direction of arrow (7) from the first printing unit via guide and deflecting rollers through all the printing units up to the last printing unit. Before leaving each printing unit, the web to be printed on rum over a drying cylinder (8) which is irradiated by ultra violet radiation means (9).

Carriages (10, 11) are carried on non-illustrated guide means of each frame (3) for displacement by linear drives. On the guide means the plate cylinders (12) and the inking cylinder (13) are mounted in respective bearings. The usual inking units assigned to the inking cylinders have not been shown. For a rapid exchange of the inking cylinder (13) and of the plate cylinder (12), the bearings supporting them may consist of known hinged bearings, wherein the upper bearing shells (14, 15) of the bearings can be taken off. Lifting jacks (18, 19) mounted on bars (20, 21 ) that can be moved out and retracted are assigned to each journal (16, 17), projecting beyond the bearings, of the plate cylinders (12) and of the inking cylinders (13). These bars are carried in guide means (23, 24). The bars (20, 21) may be the piston rods of fluid pressure-operated piston and cylinder units, or toothed racks that are moved by pinion drives.

The carriages (10, 11) mounting the plate cylinders (12) and inking cylinders (13) are carried on guide means that are straight and parallel to each other. Above the printing units (1, 2), is rail (24) that is also straight and is fixed in position. The rail extends parallel to all the guide means for the carriages. An elongate trolley (26), which extends over the length of the whole printing press, has its wheels running on the rail (24). The straight central bar (27) of the trolley (26) has freely projecting supporting arms (29, 30) arranged on vertical bracket-type supports (28) which are directed towards each other. These supports have respective scoop-shaped receiving means (31) for the journals of the cylinders (12, 13). The cantilever arms (29, 30) extend horizontally and parallel to the guide means of the carriages (10, 11).

The trolley (26) is provided with a drive, not shown, by means of which it is displaceable so as to be accurately placed, into its individual positions for receiving and delivering the cylinders to be exchanged.

FIGS. 2 to 7 respectively show a printing unit of the printing press during the individual steps of exchanging the plate cylinder and the inking cylinder.

Figure 2:
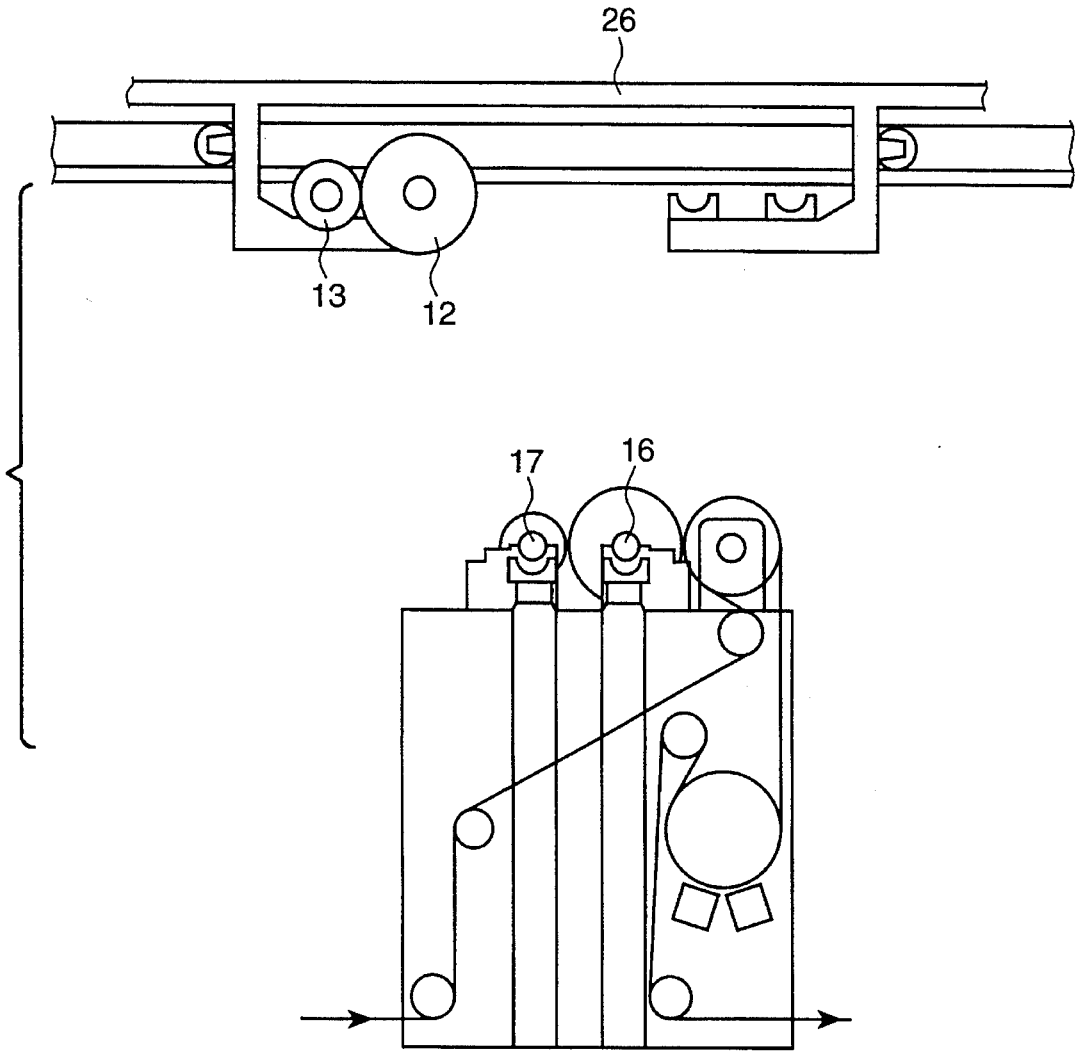
FIG. 2 is a representation, corresponding to FIG. 1; of only one printing unit with the carriage, in one cantilever arm whereof two new cylinders are held.

In FIG. 1, the plate cylinders and impression cylinders of the printing units (1, 2) are situated in their printing position, so that the shaft journals of these cylinders lie eccentrically with respect to the receiving scoops of the lifting jacks (18, 19). However, if the cylinders are moved out into the printing-off position or exchange position, for the purpose of being changed, the shaft journals (16, 17) lie centrally above the receiving scoops of the lifting jacks (18, 19), as shown in FIG. 2. In the position shown in FIG. 2, the bearings supporting the plate cylinder and the inking cylinder have already been opened, so that the upper shells closing the bearings have been lifted off. Moreover, the new plate cylinders (12) and the inking cylinders (13) have already been moved by the trolley (26) into their exchange positions.

Figure 3:
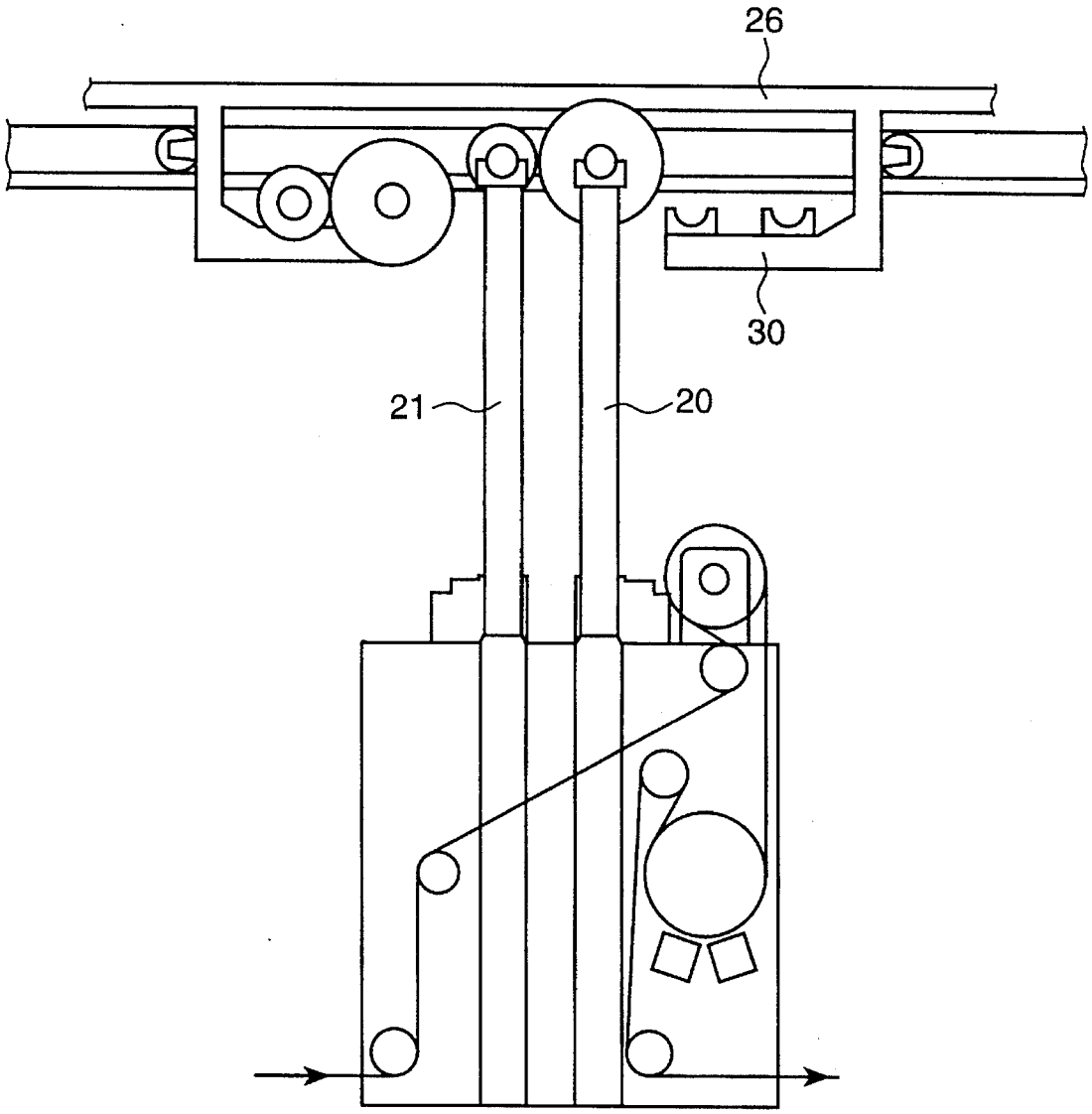
FIG. 3 is a representation, corresponding to FIG. 2, wherein two cylinders to be exchanged by means of the lifting jacks have been run out above the cantilever arm receiving them.
Figure 4:
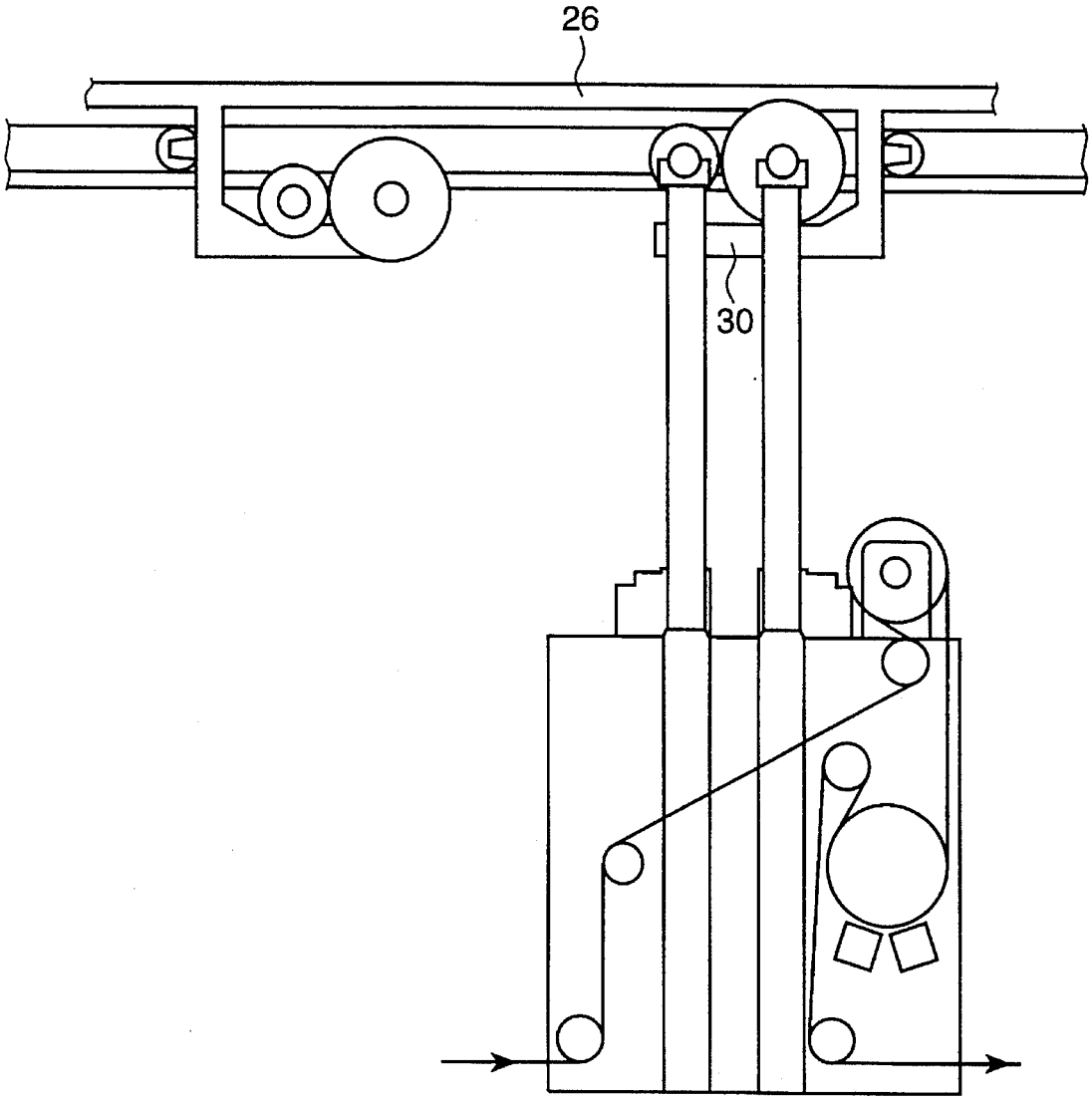
FIG. 4 is a representation, corresponding to FIG. 3, wherein the carriage is situated in a position wherein the cylinders lifted out by the lifting jacks can be lowered round the receiving means of the cantilever arm removing them.
Figure 5:
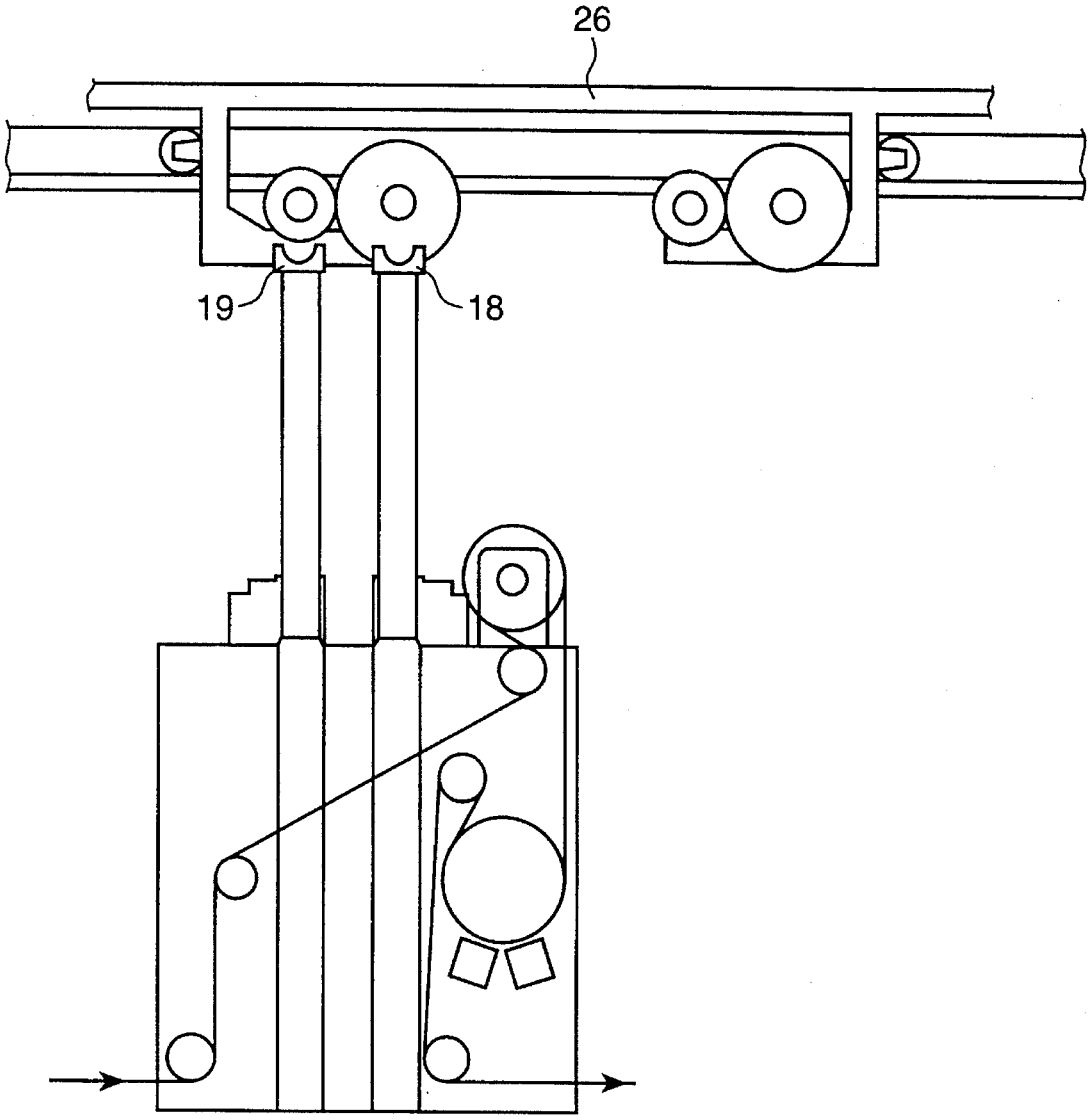
FIG. 5 is a representation, corresponding to FIGS. 2 to 4, wherein the cantilever arm holding the new cylinders has been displaced into a position wherein the cylinders can be received by the lifting jacks.

In the position shown in FIG. 3, the bars (20, 21) carrying the lifting jacks have been moved out so far that the shaft journals of the lifted-out cylinders are situated above the receiving scoops (31) of the cantilever arm (30). From the position shown in FIG. 3, the trolley (26) is then moved into the position shown in FIG. 4, so that the cylinders (12, 13) can be deposited with their shaft journals into the take-up scoops (31) of the cantilever arm (30).

Subsequently, the bars (20, 21) are retracted so far that they are detached from the shaft journals deposited in the receiving scoops (31). The trolley (26) is then moved into the position shown in FIG. 5, so that the lifting jacks (18, 19) can lift the new cylinders out of their receiving scoops.

Figure 6:
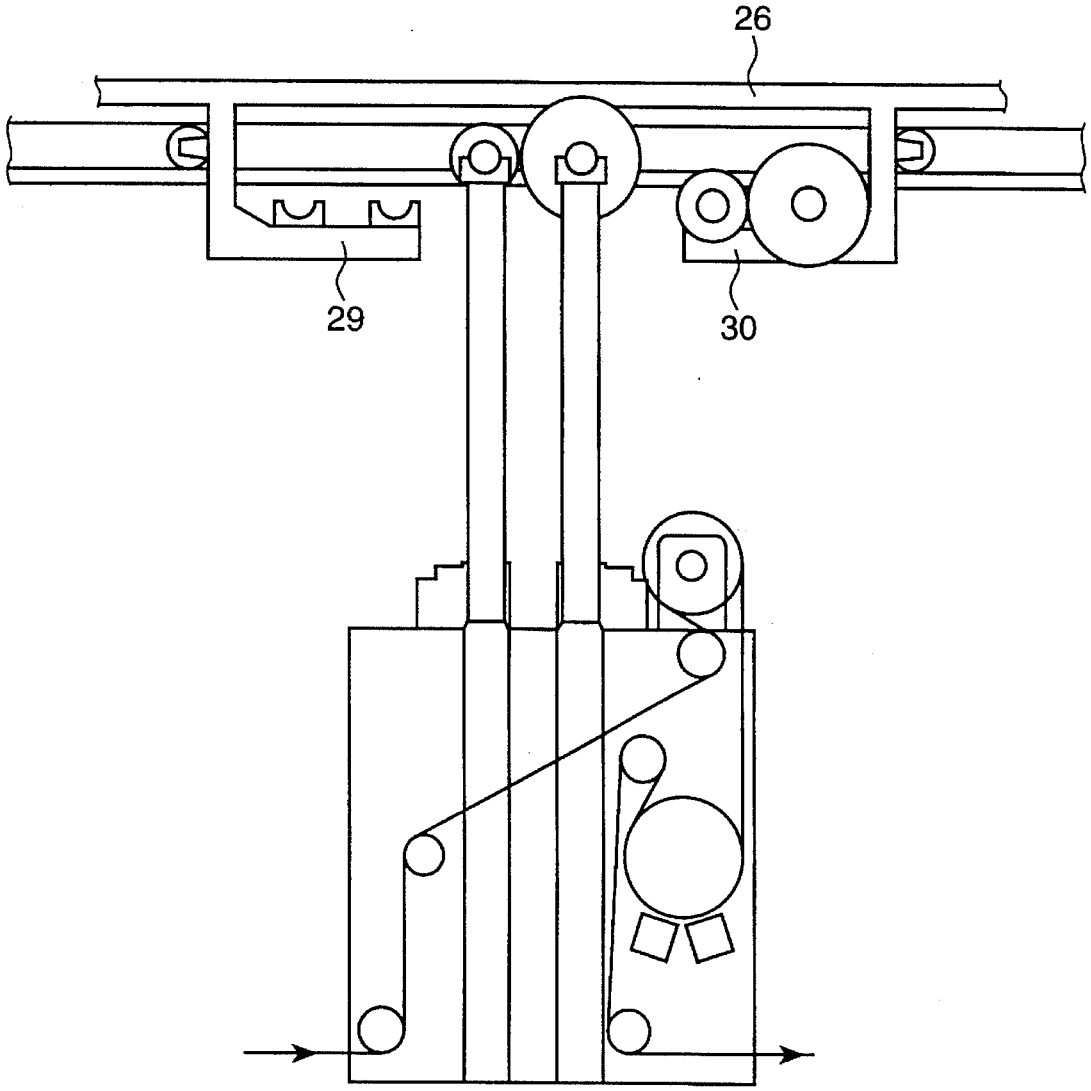
FIG. 6 is a representation corresponding to FIGS. 2 to 5, wherein the carriage has been displaced into a position where the cylinders received by the lifting jacks can be lowered into the bearings of the printing press.

Subsequently, the trolley (26) is displaced into the position shown in FIG. 6, wherein the new cylinders carried by the lifting jacks lie between the ends of the freely projecting arms (29, 30), so that they can be lowered between them into their bearings on the carriage of the printing unit.

Figure 7:
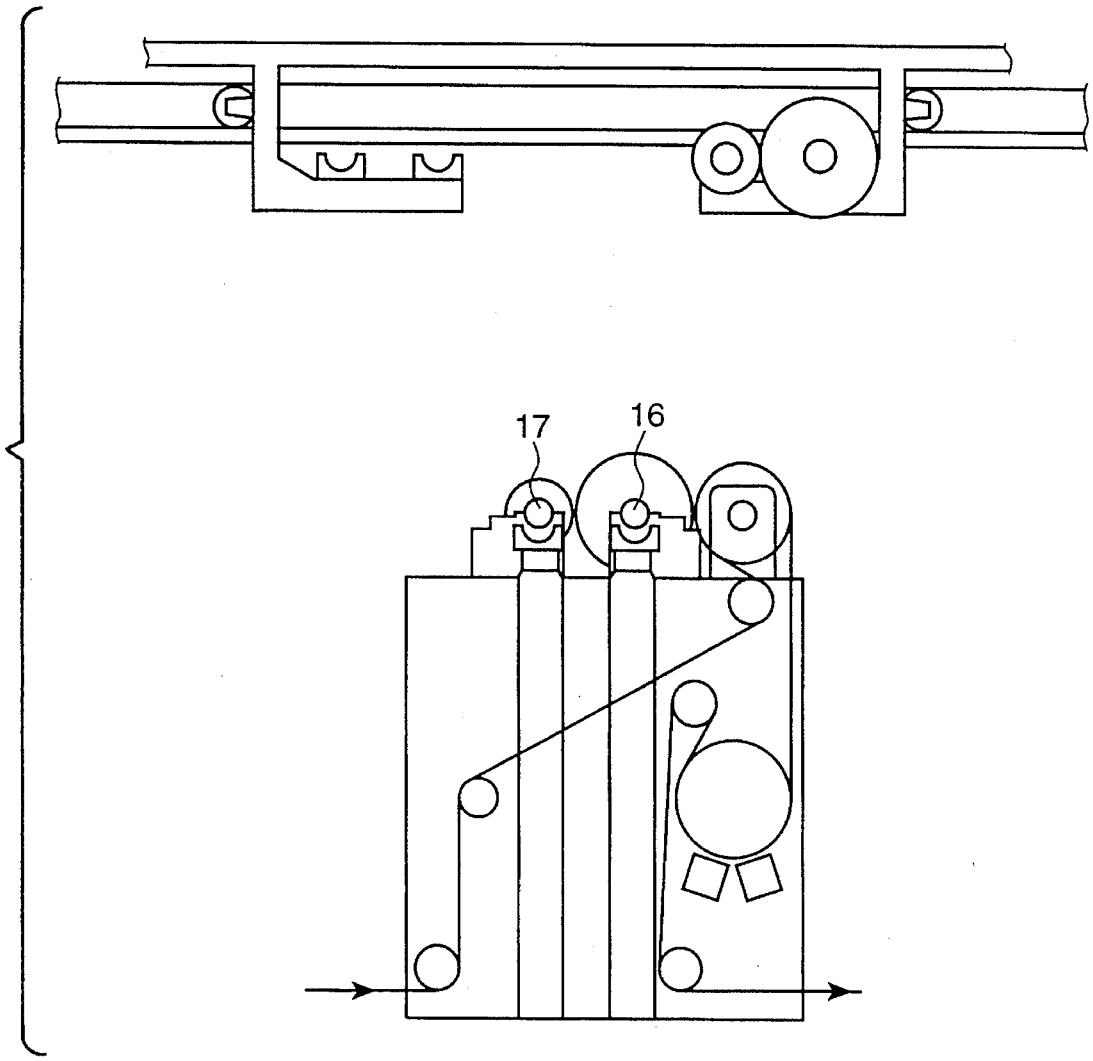
FIG. 7 is a representation corresponding to FIGS. 2 to 6, wherein the new cylinders have been lowered into the bearings of the printing press.

FIG. 7 shows the cylinders, lowered by the lifting jacks, which have been inserted with their shaft journals (16, 17) into the open bottom shells of the bearings, so that the bearings need only be closed by the fitting of the upper bearing shells in order to complete the changeover of the printing press for a new print run.

I claim:

1. A printing press, consisting of a row of several printing units each having one inking unit, cylinders exchangeable for diverse print runs and having their bearings arranged on a carriage displaceable in the printing press frame, and an impression cylinder mounted in the machine frame; wherein the printing press includes means for lifting out and removing the exchangeable cylinders, and conveyance means including a trolley displaceable on a rail; wherein the carriages are displaceable on at least one horizontal guide means of each printing press frame; wherein lifting jacks are assigned to the shaft journals of the exchangeable cylinders of each printing unit, which journals project outwardly beyond the bearings; wherein the trolley is displaceable on a rail approximately parallel to the carriages of all the printing units; wherein the trolley extends over the length of all the printing units and has pairs, assigned to each printing unit, of freely projecting arms that are substantially parallel to the carriage guide means, with receiving means for the shaft journals of the exchangeable cylinders; and wherein the lifting jacks can be raised above the arms.

2. A printing press according to claim 1, wherein, the trolley has two pairs of arms assigned to each printing unit, one of which pairs serves to hold freshly fed cylinders, and the other pair serves to receive the cylinders to be exchanged.

3. A printing press according to claim 1, wherein the respective two pairs of freely projecting arms are directed towards each other with their two ends, and the ends are interspaced from each other by such a distance that the groups of lifted-out cylinders can be freely carried through by the lifting jacks between these ends.

4. A printing press according to claim 1 wherein the trolley is displaceable, between the individual positions required for the cylinder exchange, by a positioning drive.

5. A printing press according to claim 1 wherein the press is a flexographic printing press.

6. A printing press according to claim 1 wherein each printing unit also includes an exchangeable inking roller and an exchangeable plate cylinder.

* * * * *